United States Patent [19]

McCallum

[11] Patent Number: 4,498,666

[45] Date of Patent: Feb. 12, 1985

[54] RACETRACKS

[76] Inventor: Neville C. McCallum, 2/111 Wingewarra St., Dubbo, NSW 2830, Australia

[21] Appl. No.: 438,962

[22] PCT Filed: Mar. 8, 1982

[86] PCT No.: PCT/GB82/00074

§ 371 Date: Oct. 28, 1982

§ 102(e) Date: Oct. 28, 1982

[87] PCT Pub. No.: WO82/03336

PCT Pub. Date: Oct. 14, 1982

[30] Foreign Application Priority Data

Mar. 24, 1981 [GB] United Kingdom ..... 8109128
Nov. 16, 1981 [GB] United Kingdom ..... 8134407

[51] Int. Cl.³ ..... A63K 1/00

[52] U.S. Cl. ..... 272/5; 119/15.5 A

[58] Field of Search ..... 272/5, 4, 3; 119/15.5, 119/19; 49/9, 95, 100, 168, 177, 380

[56] References Cited

U.S. PATENT DOCUMENTS 596,023 12/1897 Barrett ..... 272/4 UX
647,166 4/1900 Stedeker ..... 119/15.5
738,293 9/1903 Chapman ..... 119/15.5 X
2,770,219 11/1956 Ferris ..... 119/15.5

FOREIGN PATENT DOCUMENTS 82511 1/1977 Australia ..... 272/5
373012 2/1945 France ..... 272/5
1404526 5/1965 France ..... 272/5
454533 1/1950 Italy ..... 272/5
571973 1/1958 Italy ..... 272/5

*Primary Examiner*—Robert A. Hafer
*Assistant Examiner*—Arnold W. Kramer
*Attorney, Agent, or Firm*—Cushman, Darby & Cushman

[57] ABSTRACT

This invention relates to improvements in horseracing tracks and in particular to achieving "fail-safe" handicapped "flying starts" in horseracing, comprising of a racetrack at least a part of which may be divided into a plurality of discrete, adjoining running lanes, and said running lanes are separated by barrier rails 3, and starting gates 4 are attached to the barrier rails, characterized by separate acceleratable automatically-operable starting gates 4 which may be placed at equal distance race starting positions or at different distance handicapped race starting positions relative to a winning post for each competing horse in its own running lane, linear induction motors are provided to cause the plurality of starting gates to be moved forward in precise unison at a predetermined rate of acceleration with each competing horse following its own starting gate in its own running lane, the arrangement being such that, when the starting gates simultaneously arrive at a preselected race starting position in each running lane, all of the said gates are opened simultaneously automatically, subsequently being braked to a stop, which allows all competing horses to start in a race at any desired racing pace and carry the same "all-up weight" in lieu of individual weight handicapping.

20 Claims, 8 Drawing Figures

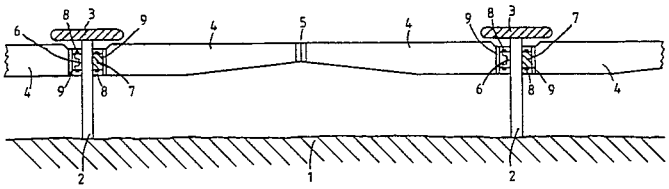

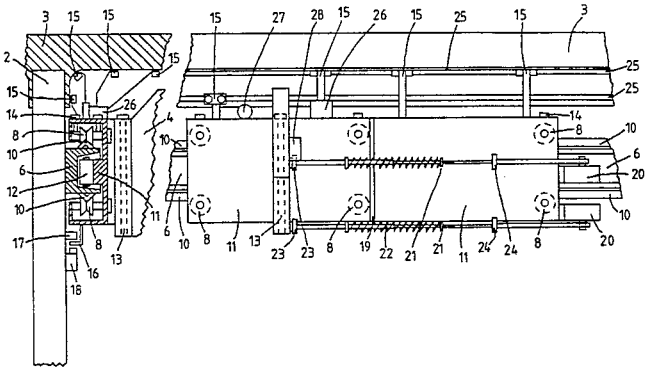

RACETRACKS

This invention relates to flat racing and harness racing and more particularly to an improved track for such racing, as described in my co-pending British Patent Applications No. 81 09128 dated 24-3-1981, No. 81 34407 dated 16-11-1981 and No. 82 00696 dated 11-1-1982.

A present disadvantage in such types of horseracing, and particularly so in harness racing, is the difficulty in obtaining an unobstructed run during the final stages of races.

A further disadvantage, which relates to flat racing, is that controlling racing organizations stipulate in their Rules of Racing that the winner of most handicap races will incur a weight penalty. These penalties are added to any future race weights which have been allocated by handicappers to the winning horse, and eventually a situation develops in which a horse which continues to win handicap races is required to carry excessive weights in races and said horse sometimes bleeds from the nostrils, or physically breaks down during the running of races.

Another disadvantage in flat racing is referred to as the "draw", which means the starting positions of horses at the starting barrier, or stalls.

If the racetrack is straight the "draw" is unimportant but on a turning racetrack the "draw" becomes important, particularly so in sprint races which have large fields, as the horses which start near the inner rail often have a distinct advantage over horses which start wider out, and accordingly it is the custom for racing authorities to allocate starting positions by lot.

In harness racing, it is well known that some harness horses have a tendency to "break" and gallop in their harness when their driver suddenly attempts to obtain full racing pace within a few seconds after the start. It thus follows that a "flying start" is the answer to this problem, and to this end the well-known mobile folding starting gate has been used, mounted on a motor vehicle.

This type of "flying start" is an efficient method of starting a horse race, but it can only be used in races in which all the horses start from the same barrier position, and it cannot be used in conventional harness handicap races because the competing horses in such type of races are required to start from different distance starting positions for each horse, called "staggered" starting positions, and said positions are stationary, allocated handicap positions.

It is therefore an object of the present invention to overcome the above and other disadvantages by the provision of a racetrack at least a part of which is divided into a plurality of discrete, adjoining running lanes by a barrier rail and each running lane having a pair of automatically-operable starting gates, one gate of each pair being movable mounted on one side of a said barrier rail, means being provided to cause the plurality of starting gates to be moved forward in unison at a predetermined rate of acceleration, the arrangement being such that, when the starting gates simultaneously arrive at a preselected race starting position in each running lane, all the said gates are opened simultaneously, subsequently preferably being braked to a stop. It will be understood that the present invention is not restricted to the use of a pair of automatically-operable starting gates in each running lane, as described, as a single automatically-operable starting gate which is movably mounted on one side of a said barrier rail in each running lane may be used to start races, if desired.

The gates are preferably moved by linear induction motors.

In order that the reader may gain a better understanding of the present invention, hereinafter will be described certain embodiments thereof by way of example only and with reference to the accompanying drawings in which:

FIG. 1 is a plan view of a racetrack according to the present invention;

FIG. 2 is a cross-section of a running lane of the racetrack of FIG. 1;

FIG. 3 is a cross-section of a linear induction motor and gate-supporting mechanism;

FIG. 4 is a fragmentary, corresponding side elevation;

FIG. 5 is a top plan view corresponding to FIG. 2;

FIG. 6 is a fragmentary, side elevation, similar to that of FIG. 4;

FIG. 7 is a plan view of a second embodiment of a racetrack according to the present invention; and FIG. 8 is a variation of that of FIG. 7.

FIG. 1 is a plan view of an 'oval-shaped' racetrack according to the present invention, in this case a nine furlong track. The track is divided, by barrier rails, into 12 running lanes each of a racing width of 5 yards, more than adequate for harness racing. The track includes three inner cinder training tracks, references S, and the winning-post position is indicated by Q. Access to the running lanes and training tracks is provided by access road M, 2 yards in width, the barrier rails which pass over road M have horizontally sliding sections operable to provide access for horses and sulkies. Staggered starting positions, for a 6 furlong race in this case, are referenced A, B, C, D, E, F, G, H, I, J, K and L.

FIG. 2 is a cross-section of a running lane of the racetrack shown in FIG. 1 and shows track surface 1 and barrier posts 2. Parallel steel barrier rails 3 define each running lane and each said running lane has a pair of aluminium alloy starting gates 4 suspended from a metal U-beam 6 along which travel gate-supporting rollers 8. The starting gates 4 are hung on hinges 9 and are moved by means of linear induction motors 7, the U-beams 6 constituting the secondary 'winding'. An electromagnetic lock 5 is provided to lock starting gates 4 in the closed position.

FIG. 3 shows a gate-supporting mechanism and linear induction motor in more detail. Lane post 2 has the horizontal steel barrier rail 3 attached to its top and the horizontal metal U-beam 6 to its side. To the upper and lower limbs of U-beam 6 are welded carrier rails 10 along which the self-centering gate-supporting rollers 8 are able to travel. A gate-supporting housing 11 carries a linear induction motor three-phase primary winding 12, the U-beam 6 constituting the secondary winding. To housing 11 is attached a starting gate 4 by a hinge 13, and self-centering support rollers 8 are vertically adjustable by means of the adjustment bolts 14. Electric power contacts 15 of the brush type operate on horizontal copper conduction strips attached to, but insulated from, horizontal steel barrier rail 3.

A steel actuating arm 16 is welded to the base of housing 11 and triggers the optoelectrical device shown as a light beam 17 and a phototube 18. This device is used to cut off the electric power supply to the linear induction motor and also to the starting gate lock 5 (see FIG. 2).

FIG. 4 is a fragmentary side elevation corresponding to FIG. 3, showing the starting gate in the closed position. The barrier rail 3 is shown with its associated U-beam 6 to which the carrier rails 10 are attached, in this illustration the lane post 2 is not shown. In this embodiment the linear induction motor housing 11 is in two parts, hinged together at 19, so that an operating air gap is maintained between primary winding 12 (see FIG. 3) and secondary 'winding' 6—the U-beam—when the starting gate is moving on a curved section of barrier.

Each starting gate is actuated by twin coiled springs which are housed in circular steel housings 20, with twin spring-loaded actuating arms 21 provided with telescopic sections 22. Actuating arms 21 are hinged at positions 23 and 24. Needless to say, any other suitable means may be used to bias the gate towards the open position, for example, compression springs. The brush contacts 15, also shown in FIG. 3, operate on horizontal insulated copper conductors 25, and a reversing contact switch 26 for the linear induction motor is attached to the top of housing 11. A phototube 27 having a circular shield incorporated is mounted on housing 11. This phototube operates with a ruby laser beam as a warning device to indicate when a horse is being allowed to touch the mobile starting gates during the 'run-up' to the race starting position. A hard rubber block 28 is faced with brake lining material and attached to each starting gate. Block 28 acts as a shock absorber when the gate opens and hits U-beam 6 and also as a brake for the gate which is still moving forward in the open position after the race has been started.

FIG. 5 is a top plan view corresponding to FIG. 2, in which the starting gates 4 are shown in the half closed position 29 and also in the fully opened position 30. When the starting gates are fully opened the hard rubber blocks 28 bear against the U-beam at positions 31. The mobile gate actuating arms 21 are shown in the half-closed position with the telescopic sections 22 in an extended position. When the gates are fully closed the hinges 23 are positioned in the center of a U-beam.

When the mobile starting gate is in motion, at the start, the racehorse concerned follows in the position shown by the arrow, and if the racehorse is driven against the mobile starting gate the ruby laser beam 32 operates in conjunction with phototube 27 (see FIG. 4) which is attached to the top of a mobile gate supporting housing in each running lane. When the racehorse breaks the laser beam a shadow is cast on the photoemissive cathode of the phototube which cuts off the anode current.

This effect closes a relay and switches on a red light on a control panel which is situated on the starter's stand and said red light acts as a warning that a racehorse is being allowed to touch a starting gate and the red light also indicates the relevant running lane in which the offence is occurring.

FIG. 6 is similar to FIG. 4 and shows a linear induction motor having a housing in three parts 11A, 11B and 11C hinged together at 19A and 19B.

The linear induction motors of the present invention employ thyristors which enable the frequency of the supply to be varied from zero up to about four times its original value, and this permits the speed of the linear induction motor to be varied continuously over a wide range.

In the present application the speed of the linear motor only needs to be gradually increased over a distance of seventy (70) yards (64 meters) and a suitable rate of speed increase is 20% every fourteen (14) yards (12.8 meters) until full racing speed is attained prior to the opening of the mobile starting gates. It will be understood that the frequency of the supply may be varied as required, by automatic control of the thyristors, or by manual control from the control panel on the starter's stand.

This compact arrangement avoids all the complications associated with rotary motors, such as drive shafts and reduction gears which cannot operate in such a restricted space, and this arrangement results in improved efficiency with simplification of maintenance and improvement in reliability. It will be understood that only one linear induction motor operating on one barrier rail in each running lane is necessary to move the mobile starting gate when said gate is in the locked position, but linear induction motors operating on both barrier rails in a running lane may be used, if desired.

It will be understood that the present invention is not restricted to the use of a linear induction motor, as any suitable type of motor which is able to operate in such a restricted space may be used.

This particular application of a linear induction motor is particularly efficient as the primary winding 12 (see FIG. 3) is completely enclosed by a suitable thickness of metal which is able to complete the lines of force of the magnetic field and as a result, there is no flux leakage, and ample linear thrust becomes available simply by increasing the number of hinged sections with primary windings mounted therein.

When said gates simultaneously reach the race starting position in the running lanes steel actuating arm 16, which is welded to the bottom section of the steel housing 11B, operates the optoelectrical device which is attached to a running lane post 2 at the appropriate race starting distance.

The optoelectrical device consists of a phototube 18 and a light beam (which is obscured in FIG. 6 by the steel actuating arm 16 as the optoelectrical device is shown in the gate opening position).

When the actuating arm 16 passes between the light beam and the phototube 18 the interruption of the light beam produces a shadow on the photoemissive cathode in the phototube 18 and this action reduces or cuts off the anode current. This effect is used to open a relay which immediately cuts off power to the linear induction motor and also to the electromagnetic lock in the mobile starting gates which are spring-loaded, and as a result said mobile starting gates open immediately and release the entire racing field which is moving behind said starting gates, at full racing pace, and a "flying start" from staggered starting positions is thereby achieved. A feature of the present invention is that all the mobile starting gates may be opened automatically, and simultaneously, by using only one optoelectrical device, as described, to switch off the electric current to the linear induction motors and to the electromagnetic locks in the mobile starting gates which are wired in series in an electrical circuit, and if said electrical circuit is opened by any means it follows that all the electromagnetic locks will instantly cease to function and consequently all the spring-loaded mobile starting gates will automatically, and simultaneously, open as described.

It will be understood that the present invention is not restricted to the use of an optoelectrical device, as described, as other suitable means may be used to open the described electrical circuit, such as a lever-type electrical switch which is attached to the linear induction motor, and said switch may be operated by a metal actuating arm which is attached to the running rail at the appropriate race starting position.

Referring again to FIG. 5, after the "flying start" has been achieved the mobile starting gates align themselves parallel to, and under the horizontal barrier rails in position 30, and the rubber blocks 28, which are faced with brake lining, press against the horizontal metal U-beam 6 (not shown) and act as a braking mechanism.

The mobile starting gates cannot be moved whilst in the fully open position 30, and after the race has been run the starter switches on the electric power supply to said gates, and course attendants manually close the stationary starting gates which are automatically locked in the closed position 4 by the electromagnetic locking device 5. It will be understood that the present invention is not restricted to the use of an electromagnetic lock as described, to lock the mobile "fail safe" starting gates, as other suitable locking means may be used which will unlock the starting gates instantly under undue extreme pressure, or in an emergency, such as a bolting horse colliding with a stationary locked starting gate, or if the electrical power to the mobile starting gate is cut off by any means.

After said gates are closed the starter is able to move them to any starting position on the race track by operating the controls on the control panel, which is situated on the starter's stand.

To reverse the mobile starting gates, when closed, the starter operates the reversing contact switch 26 shown in FIG. 6. The reversing contact switch operates by reversing two of the wires of the three-phase wiring of the primary motor and this action reverses the rotating magnetic field in the linear induction motor, and said motor moves in the reverse direction at any required speed.

A desirable feature of a linear induction motor is that the rotating magnetic field provided by the primary winding may be used as a braking device.

When the linear induction motor is moving along the metal U-beam the braking action may be applied simply by activating the reversing contact switch 26 of FIG. 6. This means that the rotating magnetic field and the direction of motion are in opposite directions, thus providing a braking action, and this is known as "plugging".

If a racehorse touched the closed mobile starting gates the optoelectrical device would operate and a red light would appear on the starter's control panel, indicating the running lane in which the offence is occurring. If the racehorse continued to push the mobile starting gate said gate would not open because the electromagnetic locking device will not open unless an excessive predetermined amount of force is used against the gate.

If the horse endeavoured to push the mobile starting gate faster than the synchronous speed of the linear motor, said motor will react by applying a braking action, and said braking action will increase in power if the speed of the mobile starting gate increases beyond the synchronous speed of the linear induction motor.

Turning now to FIGS. 7 and 8, these two embodiments show how the mobile starting gates hereinbefore described and illustrated in FIGS. 1 to 6 can be employed in a different way, that is to say, in conjunction with a conventional "oval" or other shaped racetrack fenced with an inner and an outer running rail only.

In addition, any flat or harness race to be run over a given distance is enabled to be started from an alternative race starting position.

An alternative starting position for any horse race is particularly desirable in the event of any particular race starting position becoming waterlogged during periods of inclement weather, and also in the event of accidental damage occurring to the means for starting races at any starting position.

An object of these embodiments of the present invention is to provide means for preventing horses from accidentally interfering with each other (i.e. bumping and hampering) immediately after a race start has been implemented.

This type of interference usually occurs if apprenticed jockeys are participating in races. It will be understood that apprenticed jockeys naturally lack racing experience and many cannot ride a horse in a straight line, and consequently they interfere with other horses which may be better ridden and could have a winning chance.

In sprint races which are usually truly run, this type of interference can be crucial, and it is an object of the present invention to provide means which will give the better ridden horses an opportunity to sprint clear of the offending horses immediately after race starts have been implemented.

FIG. 7 is a plan view of an oval-shaped track in which the inner running rail provides a track perimeter of, say, 5 furlongs. Spaced about the periphery of the track are a number of starting chutes 33, 34, 35, 36 and 37 adjacent outer running rail 38, with 'lead-in' sections 39 to the oval.

Three inner training tracks 40 may be provided and there may be a winning post 41 and a grandstand 42. Starting chute 33 is divided into separate running lanes, each with a pair of mobile, automatically-operable starting gates just as previously described.

The starting chutes are constructed having sufficient length to provide an adequate "run-up" distance for the mobile starting gates to open and the mobile starting gates move forward within the running lanes at a uniformly increasing rate of speed, with each competing horse following its own starting gate within its own running lane.

Chutes 34, 35, 36 and 37 are of similar constructions to chute 33, and the selective positioning of them around the oval provides for two starting positions for each given distance, as will be seen.

The track of FIG. 7 is provided with a cantilevered roof 43 over a part of its width; roof 43 may be perhaps 20 feet high at its outer edge and is preferably constructed in separate adjoining sections, the better to withstand high winds. The covered part of the track may be surfaced with limestone while the uncovered track 44 may well be turfed. Alternatively, one or both tracks may be surfaced with cinders. A 'false rail' may be employed to divide the tracks.

FIG. 8 shows a similar track with starting chutes but in this case the whole of the track is roofed. Since the introduction of inexpensive, transparent roofing panels such as those of rigid vinyl, it has become more economical to construct a roof over a track than to employ an adequate staff of groundsmen.

One or more of the starting gates may be provided with a 'dolly' upon which is mountable either a television camera or a cinecamera. This may well be employed to obtain so-called 'dolly shots', either from the front or the rear of the horses, and such shots may prove invaluable for news reporting, training, enquiries and like purposes.

Alternatively, such a camera 'dolly' might be arranged to run a 'dolly track' provided on a periphery of the cantilevered roof. Such a camera could be arranged for remotely controlled movement and operation by a cameraman observing via a monitor screen.

It is generally agreed amongst horseracing enthusiasts, and handicappers, that weight stops champion horses and kills moderate horses, and therefore it appears that distance handicapping is more humane, and efficient, than weight handicapping which invariably involves the use of weak, lightweight jockeys on the limit weight.

When the "handicapped flying start", as described in the present invention, is applied to flat racing all of the competing horses in any type of flat race are enabled to carry the same "all-up weight". This means that all of the previously described serious problems associated with weight handicapping are eliminated and strong, vigorous, effectual jockeys can be used on all horses in all flat races.

The term "all-up weight" means the total weight of a fully dressed jockey, including his saddle, number cloth, stirrup leathers, girth, and weight cloth which carry the flat lead weights which are used to make the total "all-up weights" the same.

Additionally, it will be appreciated that the present invention enables "flying starts" to be implemented in harness handicap races.

What I claim is:

1. A racetrack at least part of which comprises a plurality of discrete, adjoining running lanes defined by a plurality of parallel barrier rails, each of said running lanes having an associated pair of starting gates each of which are pivotally mounted relative a respective barrier rail on one side of each lane via a housing which is movable lengthwise along a beam attached to running lane posts which support each said barrier rail, said starting gates of each pair being movable between a closed position in which they meet to form a barrier across said lane and an open position in which they lie substantially parallel to said barrier rails, the racetrack further comprising:

means for moving said pairs of starting gates relatively along the length of said barrier rails, means for controlling movement of said pairs of starting gates such that said pairs of starting gates may be moved in unison at a controlled rate of acceleration, and means for opening each of said pairs of starting gates simultaneously automatically when said gates are at a predetermined position.

2. A racetrack at least a part of which is divided into a plurality of discrete, adjoining running lanes, each running lane being separated from an adjoining running lane by a barrier rail and each running lane having a pair of automatically-operable starting gates, one gate of each pair being movably mounted on one side of a said barrier rail, means being provided to cause the plurality of pairs of starting gates to be moved in unison relatively along the length of the said barrier rails at a predetermined rate of acceleration, the arrangement being such that, when the starting gates simultaneously arrive at a preselected race starting position in each running lane, all the said gates are opened simultaneously.

3. A racetrack at least a part of which is divided into a plurality of discrete, adjoining running lanes, each running lane being separated from an adjoining running lane by a barrier rail and each running lane having an automatically-operable starting gate, said gate being movably mounted on one side of a said barrier rail, means being provided to cause the plurality of starting gates to be moved relatively along the length of the said barrier rails in unison at a predetermined rate of acceleration, the arrangement being such that, when the starting gates simultaneously arrive at a preselected race starting position in each running lane, all of the said gates are opened simultaneously.

4. A horseracing track as claimed in claim 1, claim 2 or claim 3, in which the starting gate(s) in each lane may be arranged such that they are opened at starting positions which are all at an equal race distance relative a winning post or at different distances handicapped starting positions relative to a winning post.

5. A racetrack as claimed in claim 1, 2 or 3, in which said gates are provided with braking means to bring said gates to a halt after opening.

6. A racetrack as claimed in claim 1, 2 or 3, in which each starting gate or each pair of starting gates is provided with means for moving comprising a linear induction motor movable along a U-shaped element longitudinally mounted upon the barrier rail on one or each side of the running lane, said U-shaped element constituting the secondary winding of said motor.

7. A racetrack as claimed in claim 6 in which each linear motor comprises a housing having a plurality of sections hinged to each other so that an operating air-gap is maintained between the primary and secondary windings thereof when the starting gate, or gates, move on a curved section of barrier rail.

8. A racetrack as claimed in claim 6, in which the linear motor is controlled so that it brakes said starting gate or gates should an animal attempt to push a locked pair of starting gates or a locked starting gate, at a speed faster than the synchronous speed of said linear induction motor.

9. A racetrack as claimed in claim 1, 2 or 3, in which each starting gate is biased towards the open position on unlocking.

10. A racetrack as claimed in claim 1, 2 or 3, which additionally comprises an electrically-controllable lock to lock each pair of starting gates or starting gate in the closed position and means to simultaneously automatically open the starting gates or gate in the event of a power failure or if a gate is forced open.

11. A racetrack as claimed in claim 10, in which said electrically-controllable locks are electromagnetic locks wired in series whereby each of said locks is simultaneously released when the circuit is broken.

12. A racetrack as claimed in claim 1, 2 or 3, in which each running lane is equipped with a phototube operable by a laser beam, said phototube and said laser beam source being adjacent the rear of the starting gates or gate, the breaking of said laser beam actuating a warning signal.

13. A racetrack as claimed in claim 1, 2 or 3, in which a divided part thereof is constituted by at least one starting chute leading onto an undivided part of closed loop format.

14. A racetrack as claimed in claim 13, comprising a plurality of said starting chutes being spaced about the periphery of said undivided part at preselected locations relative to a winning post in such a way that two starting positions are provided for each race over a given distance.

15. A racetrack as claimed in claim 13, in which "flying start" starting chutes are spaced about the periphery of the undivided part of the closed loop format at preselected locations relative to a winning post in such a way that race starting positions for any given distance are provided for each competing horse within the running lanes so that immediately after a "flying start" is implemented for any race each competing horse is able to obtain an immediate unobstructed run for an adequate distance within its own running lane before said horses "break lanes" onto the main course, which allows better ridden, or better driven horses, to sprint clear of inexpertly ridden, or inexpertly driven horses, before the field "break lanes".

16. A racetrack as claimed in claim 15, in which the "flying start" means allows all competing horses in all types of flat races to start in said races at any desired racing pace and carry the same "all-up weight", as described, said "all-up weight" consisting of the total weight of a fully dressed jockey including his saddle, number cloth, stirrup leathers, girth and weight cloth which carry the flat lead weights which are used to make the total "all-up weights" the same.

17. A racetrack as claimed in claim 13, in which the racetrack is covered by a roof over at least a part of its width for at least the undivided portion.

18. A racetrack as claimed in claim 17, in which a perimeter of said roof is provided with a dolly track upon which a television camera or a cinecamera camera-carrying dolly is adapted to run.

19. A racetrack as claimed in claim 13, in which a choice of roofed or unroofed racing surfaces is provided which enables flat racing and harness racing to be conducted in "all weather" conditions using only one set of starting chutes to start races on either of said racing surfaces.

20. A racetrack as in claim 19 wherein said roofed surface includes a roof provided with a dolly track upon which a television camera or a cine-camera camera-carrying dolly is adapted to run.

* * * * *